US005081951A

United States Patent [19]

Most et al.

[11] Patent Number: 5,081,951

[45] Date of Patent: Jan. 21, 1992

[54] COATER FOR A WEB OF MATERIAL THAT TRAVELS AROUND A BACKING ROLL

[75] Inventors: Egbert Most, Düsseldorf; Reinhard Knop, Bochum; Runald Meyer, Willich, all of Fed. Rep. of Germany

[73] Assignee: Jagenberg Aktiengesellschaft, Düsseldorf, Fed. Rep. of Germany

[21] Appl. No.: 543,948

[22] Filed: Jun. 26, 1990

[30] Foreign Application Priority Data

Aug. 18, 1989 [DE] Fed. Rep. of Germany ..... 3927329

[51] Int. Cl.[5] ..... B05C 11/04

[52] U.S. Cl. ..... 118/126; 118/419; 118/688; 118/692; 427/9

[58] Field of Search ..... 118/126, 689, 690, 688, 118/118, 119, 419, 692; 427/8, 9, 10; 425/141

[56] References Cited

U.S. PATENT DOCUMENTS

| | | | |
|---|---|---|---|
| 4,220,113 | 9/1980 | Wohlfeil | 118/126 |
| 4,594,063 | 6/1986 | Reifenhauser et al. | 425/141 |
| 4,899,687 | 2/1990 | Sommer et al. | 118/126 |
| 4,911,868 | 3/1990 | Reifenhauser | 425/141 |
| 4,966,093 | 10/1990 | Sommer | 118/126 |
| 4,990,079 | 2/1991 | Lorenz | 425/141 |

*Primary Examiner*—Jay H. Woo
*Assistant Examiner*—Khanh P. Nguyen
*Attorney, Agent, or Firm*—Sprung Horn Kramer & Woods

[57] ABSTRACT

A coater for a web of material, especially a web of paper or cardboard, that travels around a backing roll, with a doctor blade that presses against the backing roll and with components for adjusting the pressure that are distributed along the doctor and affect different areas along it. The adjusting components are piezotranslators (16).

10 Claims, 2 Drawing Sheets

COATER FOR A WEB OF MATERIAL THAT TRAVELS AROUND A BACKING ROLL

BACKGROUND OF THE INVENTION

The invention concerns coater for a web of material, especially a web of or cardboard, that travels around a backing roll.

DESCRIPTION OF RELATED ART

Known coaters have a roller-based or nozzle-based applicator that applies an excess of coating, paint for example, to the web. A doctor blade in a flow-control system downstream of the applicator the paint to the desired weight per area in with how hard the doctor blade presses against the backing roll.

Production-dictated in the cross-section or the web occur when webs of or cardboard are coated and necessitate local adjustments in the pressure of the doctor blade over the operating width in order to obtain a uniform coating. This is accomplished the generic coater disclosed in German Patent 2 825 907 by adjusting a limited-flexibility supporting batten that rests against the doctor blade with tension and compression screws distributed along the line of contact in accordance whether the coating weight is too high or too low a particular point. It is impossible automatically to the local distribution of the doctor blade's pressure and hen of the coating weight during the coating process. .

SUMMARY OF THE INVENTION

The object of the present invention is to provide such a coater that allows automatic local adjustment of the doctor blade pressure during the coating process.

BRIEF DESCRIPTION OF THE INVENTION

This object is attained in accordance with the invention by making the local adjusting components piezotranslators.

The "piezotranslators" employed in accordance with the invention have several advantages. They can respond very rapidly to variations in coating weight. The nanometer-fine increments of pressure adjustment allow extremely precise corrections of the coating weight. Since they are so slender, even piezotranslators that have been encapsulated to protect them from contamination can be positioned very close to one another to achieve high resolution. It is possible to re-establish the same pressure after downtimes. Wear on the edge of the doctor can be compensated for during operation.

The piezotranslators can be controlled separately and act on a flexible supporting batten that rests against the doctor below its edge.

The piezotranslators can act indirectly by way of transmission components, especially a lever-activated mechanism or a fluid-activated mechanism, that act on the doctor with a distance-transmission ratio greater than 1. This allows the coating weight to be varied over a wide range.

In a preferred embodiment, the translation is optimally coordinated over the widest possible path of adjustment with the forces that the piezotranslator can apply and with the countervailing forces that derive from the flection of the doctor blade. This is accomplished by making the ratio of the variation in the length of the piezotranslator to the distance to which the doctor blade is adjusted at its point of engagement less than 10:1.

Excessively weak tensional forces on the part of the piezotranslator can be augmented to the requisite extent by springs. Means for varying the springs' countervailing force likewise diminishes the pressure of the piezotranslator.

One embodiment of the invention will now be described with reference to the schematic drawing.

DETAILED DESCRIPTION OF THE INVENTION

Figure 1:
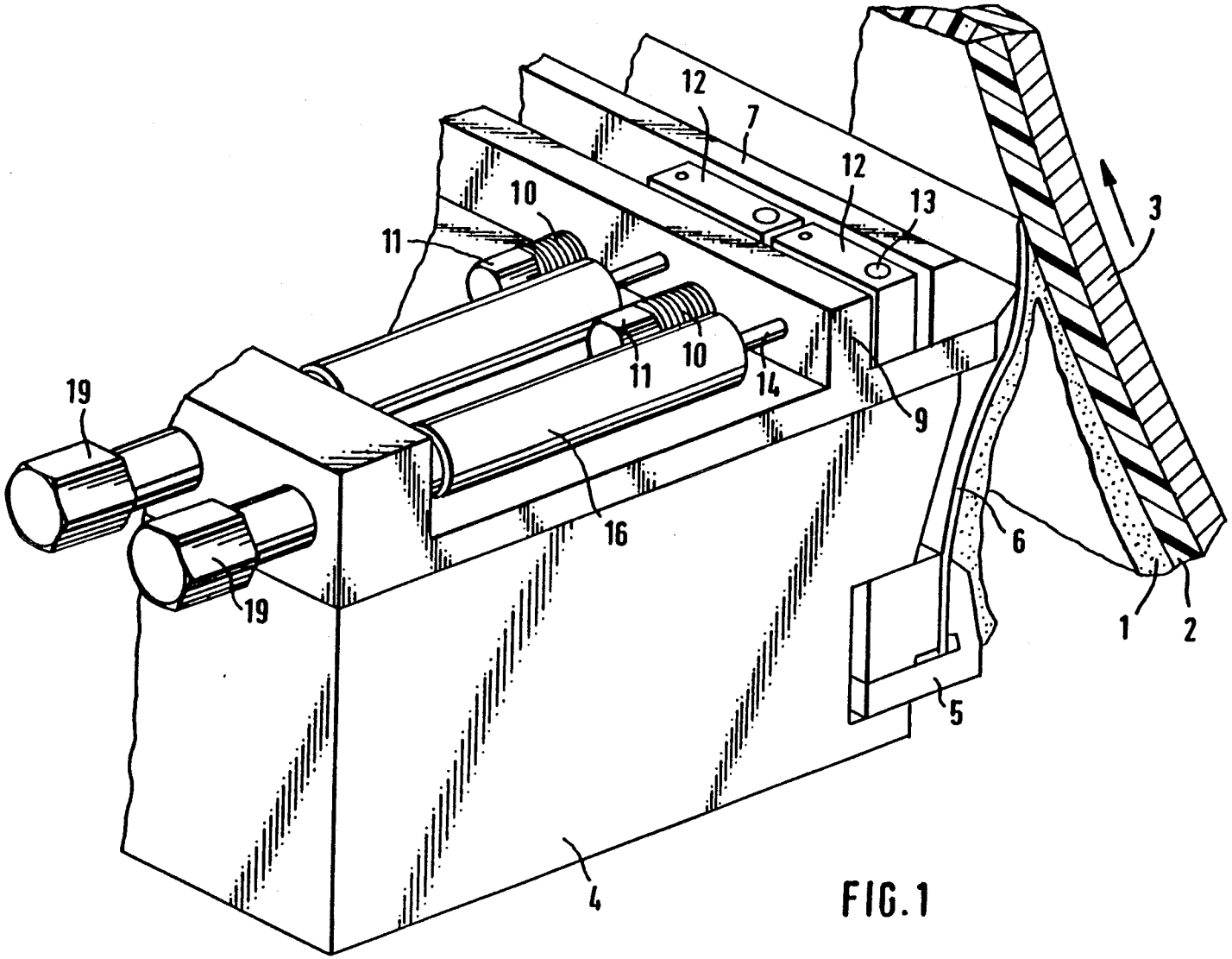
FIG. 1 is a perspective view of a coater in accordance with the invention across the web.

Coating 1 is applied in excess to a web 2 of paper or cardboard that travels around a backing roll 3 in the vicinity of a flow-control system. The flow-control system comprises a doctor blade beam 4 accommodating a tensioning beam 5 that can be advanced toward backing roll 3. The foot of the flow-control mechanism, a resilient doctor blade 6, is tensioned into tensioning beam 5.

Figure 2:
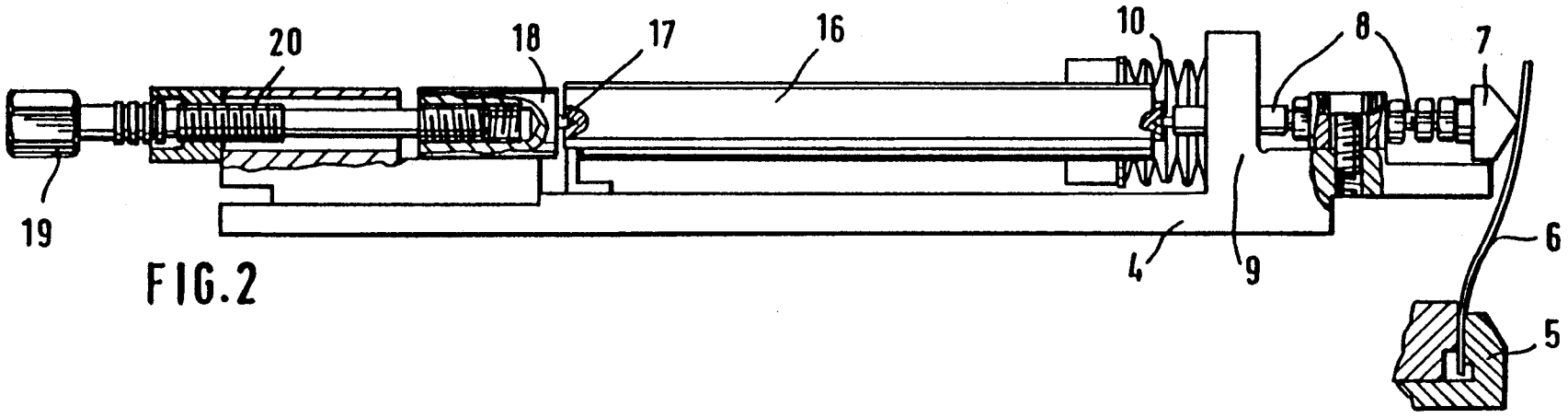
FIG. 2 is a side view.
Figure 3:
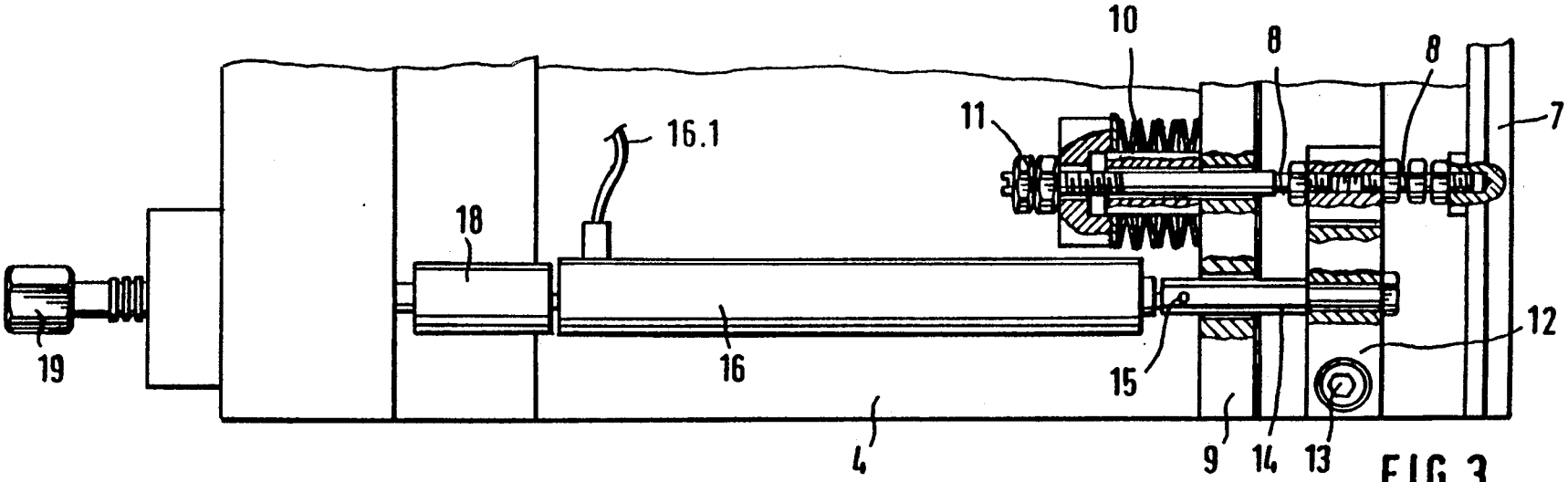
FIG. 3 is a top view of an adjustment mechanism.

Below the edge of the doctor blade that rests against backing roll 3, a supporting batten 7 engages doctor blade 6 and travels back and forth to adjust pressure more or less parallel to the direction traveled by tensioning beam 5. Supporting batten 7 extends over the operating width and has slits at regular intervals along the side opposite the line of contact or is otherwise elasticized and hence made flexible within limits in order to allow the establishment of a locally differentiated pressure along the width of doctor blade 6. Supporting batten 7 is mounted on doctor blade beam 4 with axially displaceable bolts 8 secured to the rear at regular intervals, preferably every 75 mm, and engaged by an adjusting mechanism, a preferred embodiment of which will now be described with reference to FIGS. 2 and 3.

Bolts 8 extend radially away from backing roll 3 and are mounted separated from supporting batten 7 in a batten 9 that extends over the operating width. A spring 10 that exerts a force away from backing roll 3 is mounted on the projecting end. The force of the spring can be varied with a screw 11. Articulated to bolt 8 between batten 9 and supporting batten 7 is the end of a lever 12 that essentially parallels the supporting batten. The other end of the lever rotates around a point 13 on doctor blade beam 4. Secured to lever 12 between point 13 and the attachment of bolt 8 is another bolt 14 that essentially parallels bolt 8 that transmits pressure and that can also be advanced by batten 9. Bolts 8 and 14 are secured to lever 12 where they will generate a transmission ratio of between 1:1 and 10:1 and preferably of approximately 4:1 between their respective motions. The end of bolt 14 that projects out of batten 9 is coaxially connected by way of an articulation 15 to a piezotranslator 16, the other end of which slides back and forth over doctor blade beam 4. Connected to this end at an articulation 17 is a segment 18 that slides back and forth on doctor blade beam 4 and can be positioned in relation to backing roll 3 by a screw 19 with a differential thread 20.

Pressure-driven transmission components can be employed as an alternative to the aforesaid lever-activated mechanism, and the desired transmission ratio can in particular be attained to advantage with hydraulic mechanisms.

Although the positioning screw 19 in the present embodiment is activated manually, it can also be motor-driven.

Each piezotranslator 16 is connected to an additional unillustrated source of electricity 16.1, the outputs from which can be varied by controls in accordance with measurements of the coating weight obtained in the associated area.

At the beginning of the coating process the basic pressure of supporting batten 7 is established at each point with positioning screws 19, which can be rotated to displace sliding segment 18, piezotranslator 16, and bolt 14, which in turn displace supporting batten 7 by way of lever 12 and bolt 8 in accordance with the transmission ratio. The particular base pressure employed ensures that half of the maximal voltage will be present at piezotranslators 16 (with $U_{max}=800$ V in the present case), compressing spring 10 until it is strong enough to force supporting batten 7 away from backing roll 3 when the voltage is decreased. This is necessary because commercially available piezotranslators do not have enough mechanical pre-loading to provide sufficient tensile forces.

The cross-section of the coating is fine-adjusted point by point by piezotranslators 16 during the coating process. The distribution of the coating weight is determined over the operating width, and any deviations from a uniform distribution are corrected by varying the voltage of the piezotranslator 16 at that point, expanding or contracting it axially. The variation in the length of piezotranslator 16 is magnified by lever 12 in accordance with the transmission ratio and transmitted to bolt 8, which moves the flexible supporting batten 7 toward or away from backing roll 3 at that particular point. Spring 10 will exert the requisite tension on supporting batten 7 when a piezotranslator 16 contracts. An increase or decrease in the pressure of doctor blade 6 will expand or reduce the coating weight at that point as desired.

It will be understood that the specification and examples are illustrative but not limitative of the present invention and that other embodiments within the spirit and scope of the invention will suggest themselves to those skilled in the art.

What is claimed is:

1. In a coater for a traveling web of material, including a backing roll around which the web travels, a doctor blade that presses against the backing roll, and components for adjusting the pressure distributed along the doctor blade and affecting different areas along it, the improvement wherein the adjusting components include a piezotranslator (16).

2. A coater according to claim 1, including a flexible supporting batten (7) that rests against the doctor blade (6) below its edge, the piezotranslator being controlled separately and acting on the batten.

3. A coater according to claim 1, wherein the adjusting components include transmission component between the piezotranslator's (16) and the doctor blade (6) with a distance-transmission ratio greater than 1.

4. A coater according to claim 3, wherein the transmission component is a lever-activated mechanism (8 and 12–14).

5. A coater according to claim 3, wherein the transmission component is a fluid-activated mechanism.

6. A coater according to claim 3, wherein the ratio of the variation in the length of the piezotranslator (16) to the distance to which the doctor blade (6) is capable of being adjusted at its point of engagement is less than about 10:1.

7. A coater according to claim 3, wherein the ratio of the variation in the length of the piezotranslator (16) to the distance to which the doctor blade (6) is capable of being adjusted at its point of engagement is less than about 4:1.

8. A coater according to claim 3, wherein the transmission component includes spring (10) that counteracts the pressure of the doctor blade (6) on the backing roll (3).

9. A coater according to claim 8, including means (11) for varying the countervailing force of the spring (10).

10. A coater according to claim 1, including means for displacing the piezotranslator (16) toward the backing roll (3) to establish a base position for the doctor blade (6).

* * * * *

UNITED STATES PATENT AND TRADEMARK OFFICE

CERTIFICATE OF CORRECTION

PATENT NO. : 5,081,951

DATED : January 21, 1992

INVENTOR(S) : Most et al.

It is certified that error appears in the above-identified patent and that said Letters Patent is hereby corrected as shown below:

Col. 4, line 17 Delete " piezotranslator's " and substitute
-- piezotranslator --

Signed and Sealed this

Third Day of August, 1993

*Attest:*

Michael K. Kirk

MICHAEL K. KIRK

*Attesting Officer*

*Acting Commissioner of Patents and Trademarks*